US011766870B2

(12) United States Patent
Takishima et al.

(10) Patent No.: US 11,766,870 B2
(45) Date of Patent: Sep. 26, 2023

(54) COAGULATION METHOD, COAGULATION DEVICE, AND EJECTING DEVICE

(71) Applicant: SEIKO EPSON CORPORATION, Tokyo (JP)

(72) Inventors: Keigo Takishima, Matsumoto (JP); Yoshihisa Horikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 17/655,036

(22) Filed: Mar. 16, 2022

(65) Prior Publication Data

US 2022/0297436 A1 Sep. 22, 2022

(30) Foreign Application Priority Data

Mar. 19, 2021 (JP) ..... 2021-045651

(51) Int. Cl.

| | |
|---|---|
| ***B41J 2/17*** | (2006.01) |
| ***B41J 29/17*** | (2006.01) |
| ***B41J 2/18*** | (2006.01) |
| ***B41J 2/185*** | (2006.01) |

(52) U.S. Cl.

CPC ..... *B41J 2/1714* (2013.01); *B41J 2/185* (2013.01); *B41J 29/17* (2013.01); *B41P 2231/21* (2013.01); *B41P 2235/30* (2013.01)

(58) Field of Classification Search

CPC ..... B41J 2/1714; B41J 2/185; B41J 2/1721; B41J 29/17

See application file for complete search history.

(56) References Cited

U.S. PATENT DOCUMENTS

| | | | | |
|---|---|---|---|---|
| 5,621,444 | A | 4/1997 | Beeson | |
| 6,907,826 | B1 * | 6/2005 | Berg | B41F 9/003 101/424 |
| 10,500,839 | B2 * | 12/2019 | Sato | B41J 29/377 |
| 2007/0008372 | A1 * | 1/2007 | Katada | B41J 2/1721 347/36 |

FOREIGN PATENT DOCUMENTS

| | | |
|---|---|---|
| JP | 2004-136534 A | 5/2004 |
| JP | 2015-229129 | 12/2015 |

* cited by examiner

*Primary Examiner* — Scott A Richmond
(74) *Attorney, Agent, or Firm* — WORKMAN NYDEGGER

(57) ABSTRACT

Provided is a coagulation method for a liquid, recovered from a printer, and containing pigment and a cleaning liquid. The coagulation method includes storing the recovered liquid containing the pigment and the cleaning liquid, cooling the recovered liquid such that at least a part of the recovered liquid solidifies, and heating a solid generated by solidifying at least a part of the recovered liquid in order to liquefy the solid.

6 Claims, 10 Drawing Sheets

COAGULATION METHOD, COAGULATION DEVICE, AND EJECTING DEVICE

The present application is based on, and claims priority from JP Application Serial Number 2021-045651, filed Mar. 19, 2021, the disclosure of which is hereby incorporated by reference herein in its entirety.

BACKGROUND

1. Technical Field

The present disclosure relates to a coagulation method, a coagulation device, and an ejecting device.

2. Related Art

In a transport belt cleaning method described in JP 2004-136534 A, by electrolyzing a cleaning liquid used for cleaning a medium to be cleaned, ink in the cleaning liquid is decomposed into dye and the cleaning liquid.

In the method described in JP 2004-136534 A, although dye is used for ink, no consideration is given, in a case of using ink containing pigment, to separation of the pigment. Here, ink containing pigment is used in an inkjet printer, and when a transport unit of a medium is soiled with the ink, the ink is removed by cleaning using a cleaning liquid. However, a method for separating pigment from cleaning liquid containing the pigment has not been established.

SUMMARY

In order to solve the problems described above, a coagulation method according to the present disclosure is a coagulation method for a liquid containing pigment and a cleaning liquid recovered from a liquid ejecting device, the method including storing the liquid, cooling the liquid such that at least a part of the liquid solidifies, and heating a solid generated by solidifying at least a part of the liquid in order to liquefy the solid.

A coagulation device according to the present disclosure is a coagulation device for performing coagulation treatment for a liquid containing pigment and a cleaning liquid recovered from a liquid ejecting device, the coagulation device including a storage unit configured to store a liquid containing the pigment and the cleaning liquid, and a temperature change unit configured to change a temperature of the liquid stored in the storage unit, wherein the temperature change unit cools the liquid such that at least a part of the liquid solidifies, and heats a solid generated by solidifying at least a part of the liquid in order to liquefy the solid.

An ejecting device according to the present disclosure includes a transport unit configured to transport a medium, an ejecting unit configured to eject a composition containing pigment onto the medium, a cleaner unit configured to clean, with a cleaning liquid, the transport unit to which the composition adheres, a storage unit configured to store a liquid containing the pigment and the cleaning liquid, and a temperature change unit configured to change a temperature of the liquid stored in the storage unit, wherein the temperature change unit cools the liquid such that the liquid solidifies, and heats a solid generated by solidifying the liquid in order to liquefy the solid.

DESCRIPTION OF EXEMPLARY EMBODIMENTS

Figure 1:
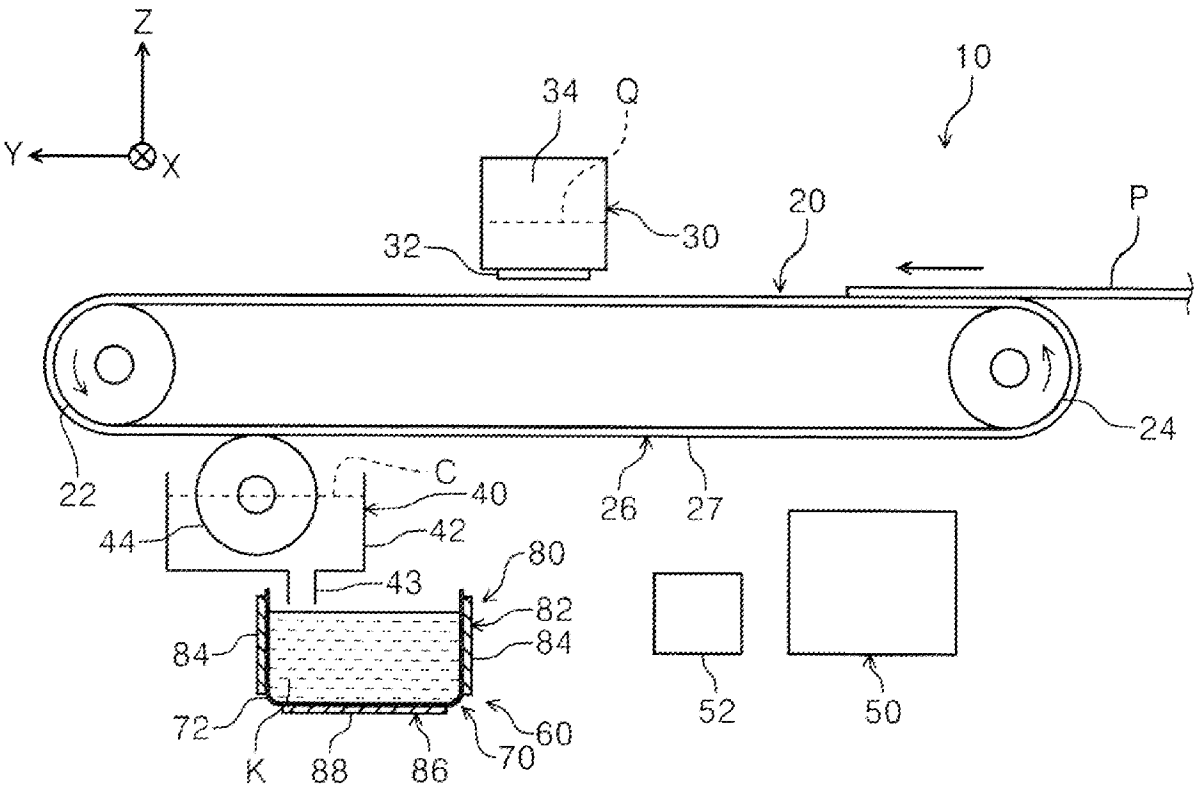
FIG. 1 is an overall configuration diagram of a printer of Exemplary Embodiment 1.

Hereinafter, the present disclosure will be schematically described.

A coagulation method according to a first aspect of the present disclosure is a coagulation method for a liquid containing pigment and a cleaning liquid recovered from a liquid ejecting device, the method including storing the liquid, cooling the liquid such that at least a part of the liquid solidifies, and heating a solid generated by solidifying at least a part of the liquid in order to liquefy the solid.

According to the present aspect, for example, the pigment is dispersed in the liquid after being used to clean a transport unit, as an element to be cleaned by the cleaning liquid. Furthermore, since the dispersed pigment coagulates, the pigment is easily recovered. This makes it easier to separate the cleaning liquid component from the liquid, making it easier to reuse the cleaning liquid for cleaning the transport unit. Note that, an element cleaned by a cleaning liquid is not particularly limited as long as the element is an element to which pigment can adhere in accordance with operation of a liquid ejecting device, and configures the liquid ejecting device.

A coagulation device according to a second aspect is a coagulation device for performing coagulation treatment for a liquid containing pigment and a cleaning liquid recovered from a liquid ejecting device, the coagulation device including a storage unit configured to store the liquid containing the pigment and the cleaning liquid, and a temperature change unit configured to change a temperature of a liquid stored in the storage unit, wherein the temperature change unit is configured to cool the liquid such that at least a part of the liquid solidifies, and heat a solid generated by solidifying at least a part of the liquid in order to liquefy the solid.

According to the present aspect, the pigment is dispersed in the liquid, which is the cleaning liquid, after being used to clean the transport unit. Furthermore, since the dispersed pigment coagulates, the pigment is easily recovered. This makes it easier to separate the cleaning liquid component from the liquid, making it easier to reuse the cleaning liquid for cleaning the transport unit.

A coagulation device according to a third aspect is the coagulation device according to the second aspect including a filtration unit configured to filter a mixture generated by heating the solid.

Mixtures include both a mixture that is composed entirely and solely of liquid, and a mixture in which a part is liquid and a remaining part is a solid.

According to the present aspect, a liquid after removing components of the pigment from the mixture using the filtration unit can be reused as the cleaning liquid for cleaning the transport unit.

A coagulation device according to a fourth aspect is the coagulation device according to the second aspect or the third aspect including a centrifugation unit configured to perform centrifugation to separate the pigment from a mixture generated by heating the solid.

According to the present aspect, by efficiently removing the pigment from the mixture using the centrifugation unit, the liquid after removing the components of the pigment from the mixture can be reused as the cleaning liquid for cleaning the transport unit.

A coagulation device according to a fifth aspect is the coagulation device according to any one of the second aspect to the fourth aspect including, when the storage unit is a first storage unit, a second storage unit configured to store the liquid, when the temperature change unit that changes a temperature of the liquid stored in the first storage unit is a first temperature change unit, a second temperature change unit configured to change a temperature of the liquid stored in the second storage unit, and a control unit configured to control operation of the first temperature change unit and operation of the second temperature change unit, wherein the second temperature change unit is capable of discharging heat to the first storage unit when the liquid is cooled, the control unit, after causing the first temperature change unit to solidify the liquid stored in the first storage unit, causes the first temperature change unit to stop operation of cooling the liquid stored in the first storage unit, and after the operation of cooling the liquid stored in the first storage unit by the first temperature change unit is stopped, performs control such that the second temperature change unit cools the liquid stored in the second storage unit while discharging heat to the first storage unit.

According to the present aspect, a solidified solid in the first storage unit can be restored to liquid, by using discharged heat from the second temperature change unit without heating using the first temperature change unit.

An ejecting device according to a sixth aspect includes a transport unit configured to transport a medium, an ejecting unit configured to eject a composition containing pigment onto the medium, a cleaner unit configured to clean, with a cleaning liquid, the transport unit to which the composition adheres, a storage unit configured to store a liquid containing the pigment and the cleaning liquid, and a temperature change unit configured to change a temperature of the liquid stored in the storage unit, wherein the temperature change unit is configured to cool the liquid such that the liquid solidifies, and heat a solid generated by solidifying the liquid in order to liquefy the solid.

According to the present aspect, since the dispersed pigment is coagulated, the pigment is easily recovered. This makes it easier to separate the cleaning liquid component from the liquid, making it easier to reuse the cleaning liquid for cleaning the transport unit.

Furthermore, since the pigment is easily separated from the liquid, it is possible to suppress a reduction in cleaning performance of the transport unit, when the cleaning liquid is reused.

Exemplary Embodiment 1

Hereinafter, a coagulation method, a coagulation unit 60, and a printer 10 according to Exemplary Embodiment 1 of the present disclosure will be described in detail.

FIG. 1 illustrates an overall configuration of the printer 10.

The printer 10 is an example of an ejecting device, and performs recording on a sheet P, which is an example of a medium. Other examples of the medium include fiber. Note that, an X-Y-Z coordinate system illustrated in each figure is an orthogonal coordinate system.

An X direction is a device width direction of the printer 10, and as an example, is a horizontal direction. A tip side of an arrow indicating a direction is defined as a +X direction, and a base end side of the arrow indicating the direction is defined as a −X direction. Furthermore, the X direction is an example of a width direction of the sheet P and a width direction of a glue belt 26 described below.

A Y direction is a depth direction of the printer 10, and is the horizontal direction. The Y direction is orthogonal to the X direction. A tip side of an arrow indicating a direction is defined as a +Y direction, and a base end side of the arrow indicating the direction is defined as a −Y direction. The +Y direction is also an example of a transport direction in which the sheet P is transported.

A Z direction is along a gravitational direction in which gravity acts. A tip side of an arrow indicating a direction is defined as a +Z direction, and a base end side of the arrow indicating the direction is defined as a −Z direction. The +Z direction is a device height direction of the printer 10, and is orthogonal to both the Y direction and the X direction.

The printer 10 includes, as an example, a body frame (not illustrated), a transporting unit 20, a record unit 30, a cleaning unit 40, a controlling unit 50, a power source 52, and the coagulation unit 60.

The transporting unit 20 is provided at the body frame. In particular, the transporting unit 20 includes a driving roller 22, a driven roller 24, the glue belt 26, and a motor (not illustrated). Then, the transporting unit 20 transports the sheet P supported by the glue belt 26 in the +Y direction, in accordance with movement of the glue belt 26 by rotation of the driving roller 22. In the +Y direction, the driving roller 22 is disposed downstream the driven roller 24. In addition, both the driving roller 22 and the driven roller 24 include a rotary shaft in the X direction. Rotation of the driving roller 22 is controlled by the controlling unit 50 described below controlling operation of the motor.

The glue belt 26 is an example of a transport unit, and transports the sheet P in the +Y direction. The glue belt 26 is configured as an endless belt obtained by joining both ends of a planar plate having elasticity. Further, the glue belt 26 is wound around an outer circumferential surface of the driving roller 22 and an outer circumferential surface of the driven roller 24. In other words, the glue belt 26 is capable of transporting the sheet P by being cycled.

As an example, a front surface 27 of the glue belt 26 has adhesiveness, and is capable of supporting and adsorbing the sheet P. The adhesiveness refers to a property that makes temporarily bonding with another member and peeling in a bonded state possible.

The record unit 30 is an example of a recording unit. Furthermore, the record unit 30 is capable of recording information on the sheet P transported in the +Y direction. Specifically, the record unit 30 includes a recording head 32, which is an example of an ejecting unit, and a carriage 34 that supports the recording head 32 so that reciprocating movement is possible along the X direction. Also, the record unit 30 is disposed above the glue belt 26.

The recording head 32 has a plurality of nozzles (not illustrated), and is disposed in the +Z direction with respect to the front surface 27. Additionally, the recording head 32 can perform recording on the sheet P by ejecting ink Q from the plurality of nozzles onto a recording surface of the sheet P.

The ink Q is an example of a composition. The ink Q includes a black ink, and color inks different from the black ink. Examples of colors of the color ink include yellow, cyan, and magenta. Specifically, the ink Q includes a pigment G (FIG. 3) as a color material, a solvent for ensuring ejection stability and preservation stability of ink, a surfactant, a pH adjusting agent, a preservative, and an anti-mold agent. Note that, in the present exemplary embodiment, the pigment G of the black ink is used, as an example.

As the pigment G, both of an inorganic pigment and an organic pigment can be used. The inorganic pigment is not particularly limited, and examples thereof include carbon black, iron oxide, titanium oxide, and silica oxide, for example.

The organic pigment is not particularly limited, but examples thereof include, for example, a quinacridone-based pigment, a quinacridone quinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrorpyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, and an azo-based pigment.

The cleaning unit 40 is an example of a cleaner unit. The cleaning unit 40 is disposed at a predetermined position in the −Z direction with respect to the glue belt 26. Specifically, the cleaning unit 40 includes a cleaning tank 42 and a cleaning brush 44.

The cleaning tank 42 is disposed in a state of opening in the +Z direction. An outflow pipe 43 is coupled to a bottom of the cleaning tank 42. A valve (not illustrated) is provided at the outflow pipe 43 so as to be able to open and close.

In the cleaning tank 42, a cleaning liquid C is stored. For example, the cleaning liquid C is formed of water or an organic solvent. Note that, the cleaning liquid C may contain additives such as surfactants as necessary.

The cleaning brush 44 is rotatable about a central axis along the X direction, provides the cleaning liquid C to the front surface 27 in accordance with rotation while recovering the ink Q on the front surface 27.

In this way, the cleaning unit 40 cleans the front surface 27 of the glue belt 26 to which the ink Q adheres with the cleaning liquid C.

Here, a liquid containing the pigment G and the cleaning liquid C is referred to as a recovered liquid K. The recovered liquid K is an example of a liquid containing the pigment G and the cleaning liquid C. Note that, a recovered liquid before a temperature thereof is changed by a temperature change unit 80 described below is referred to as the recovered liquid K, and a recovered liquid after the temperature thereof is changed by the temperature change unit 80 is referred to as a mixture M (FIG. 4), and the two are distinguished. Chemical composition of the mixture M is the same as chemical composition of the recovered liquid K. However, the chemical composition of the mixture M may be different from the chemical composition of the recovered liquid K. For example, the chemical composition of the recovered liquid K changes during a process of heating the recovered liquid K, and as a result, the chemical composition of the mixture M may be different from the chemical composition of the recovered liquid K.

The controlling unit 50 is configured to include a central processing unit (CPU) (not illustrated), a read only memory (ROM), a random access memory (RAM), and a storage (not illustrated), and controls operation of each unit of the printer 10.

The power source 52 is controlled by the controlling unit 50, and is capable of powering each unit of the printer 10. A part of power of the power source 52 is used for operation of the temperature change unit 80 described below.

The coagulation unit 60 is an example of a coagulation device for coagulating pigments G from the recovered liquid K. The coagulation unit 60 includes a storage unit 70 and the temperature change unit 80. The coagulation unit 60 performs coagulation treatment. The coagulation treatment includes treatment for storing the recovered liquid K, treatment for cooling the recovered liquid K such that at least a part of the recovered liquid solidifies, and treatment for heating a solid S (FIG. 3) such that the solid S generated by solidifying at least a part of the recovered liquid K liquefies. Note that, the solid S will be described below.

The storage unit 70 has a reservoir 72, as an example. The reservoir 72 is open in the +Z direction, and is disposed in the −Z direction with respect to the cleaning tank 42. The reservoir 72 stores the recovered liquid K flowing from the cleaning tank 42 through the outflow pipe 43.

Note that, the cleaning unit 40 and the storage unit 70 are supported by a sliding unit (not illustrated), and the sliding unit is moved in the X direction, thereby allowing extraction from the body frame or storage in the body frame.

As an example, the temperature change unit 80 includes the power source 52, a cooling unit 82, and a heating unit 86. As an example, operation of the temperature change unit 80 is controlled by the controlling unit 50 to change a temperature of the recovered liquid K stored in the storage unit 70.

The cooling unit 82 includes, as an example, a cooling plate 84 that is constituted by a Peltier element and to which a heat sink (not illustrated) is attached. The cooling plate 84 is attached to a side portion of the reservoir 72, as an example. When the power source 52 energizes the cooling plate 84, the cooling unit 82 cools the reservoir 72. Note that, the cooling unit 82 can cool an inside of the reservoir 72 to a temperature lower than 0° C. A material constituting the reservoir 72 may be metal such as iron, stainless steel, or aluminum.

Figure 3:
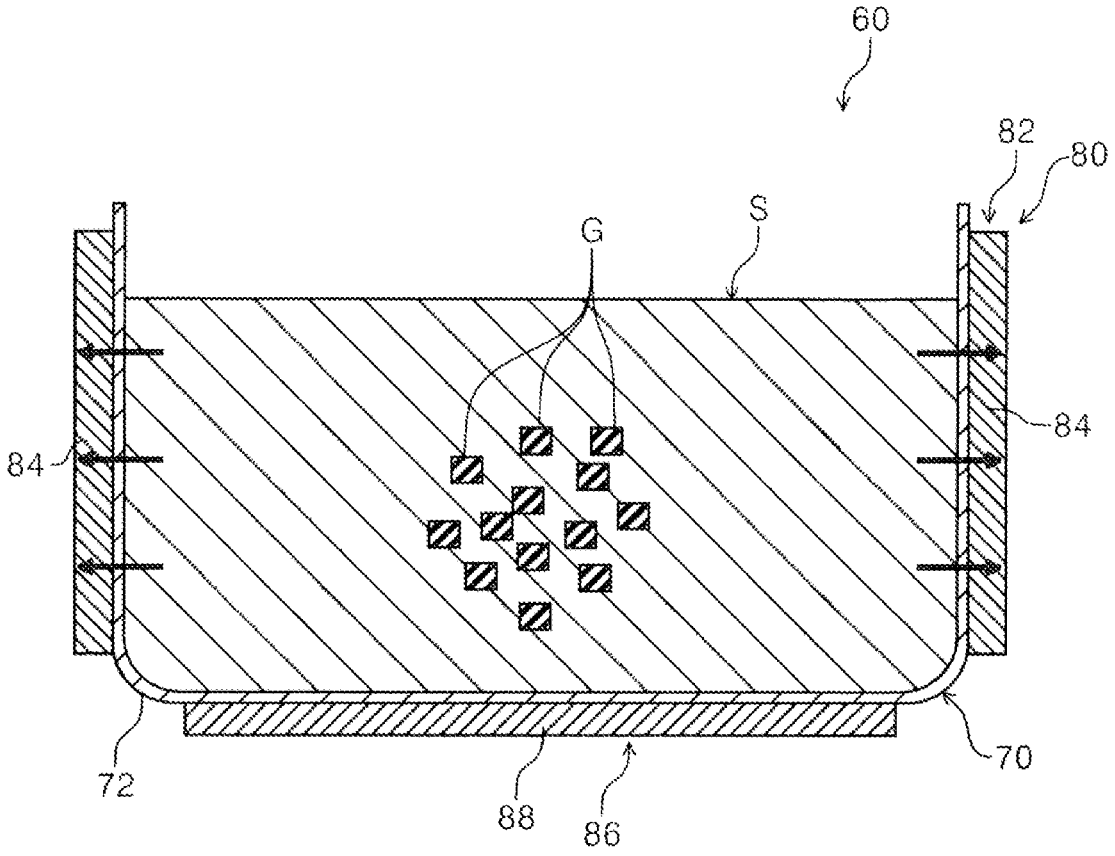
FIG. 3 is a schematic diagram illustrating a state in which the recovered liquid in the coagulation unit of Exemplary Embodiment 1 is solidified.

The heating unit 86 includes, as an example, a heating plate 88 formed of a planar heating element attached to a bottom of the reservoir 72. When the power source 52 energizes the heating plate 88, the heating unit 86 heats the reservoir 72. The heating unit 86 heats the frozen or solidified recovered liquid K by the cooling unit 82 so as to melt, and changes a state thereof to the mixture M. Note that, the frozen recovered liquid K is referred to as the solid S (FIG. 3).

In this way, the temperature change unit 80 cools the recovered liquid K such that at least a part of the recovered liquid K solidifies. Furthermore, the temperature change unit 80 heats the solid S such that the solid S generated by solidifying at least a part of the recovered liquid K liquefies.

Next, an action of the coagulation method, the coagulation unit 60, and the printer 10 according to Exemplary Embodiment 1 will be described.

As illustrated in FIG. 1, after recording is performed by the record unit 30 on the sheet P to be transported, a part of the ink Q may adhere to the front surface 27 of the glue belt 26. For example, this applies to a case where marginless recording is performed on the sheet P, and the like. A part of the ink Q adhering to the front surface 27 is cleaned in the cleaning unit 40, recovered in the cleaning tank 42 together with the cleaning liquid C, and becomes the recovered liquid K. Then, by opening the valve (not illustrated), the recovered liquid K flows from the cleaning tank 42 to the reservoir 72, and is stored in the reservoir 72.

Figure 2:
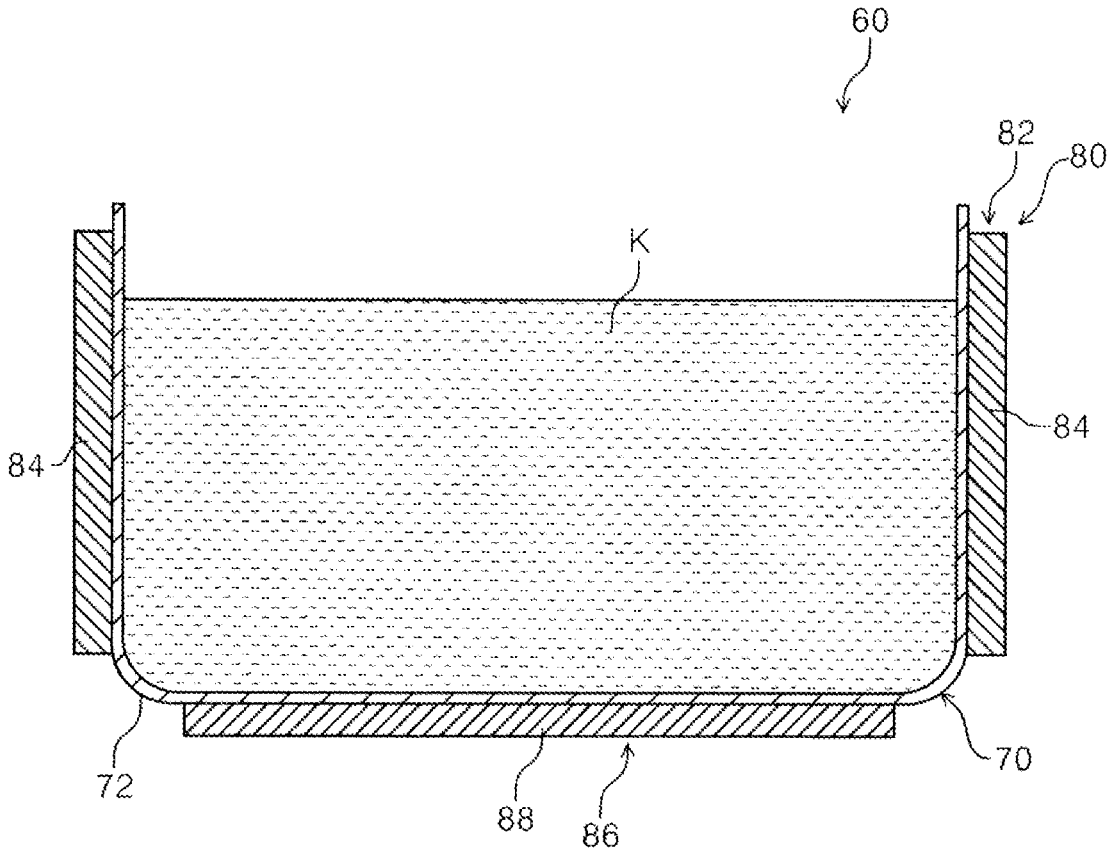
FIG. 2 is a schematic diagram illustrating a state in which a recovered liquid is recovered in a coagulation unit of Exemplary Embodiment 1.

As illustrated in FIG. 2 and FIG. 3, in a state where the recovered liquid K is stored in the reservoir 72, the cooling unit 82 is energized by the power source 52 (FIG. 1). A temperature of the cooling plate 84 is decreased due to a Peltier effect. As a result, a temperature of the recovered liquid K is decreased such that at least a part of the stored recovered liquid K solidifies. As a result, the stored recovered liquid K solidifies. Arrows in the figure represent heat movement. Since the heating unit 86 is not energized while the cooling unit 82 cools the recovered liquid K, heating is not performed.

Note that, when the recovered liquid K was observed during solidification, an outer edge part of the recovered liquid K was brought into a state of being close to transparent, and a state in which the pigments G (FIG. 3) collect inside the recovered liquid K was seen. The outer edge part of the recovered liquid K is a part where solidification is started earlier in time compared to an inside of the recovered liquid K, and includes a part of the recovered liquid K that comes into contact with an inner wall of the reservoir 72.

As illustrated in FIG. 3, the pigments G coagulate in the solid S generated by solidifying the recovered liquid K. Note that, the pigments G are illustrated as a plurality of quadrangles to facilitate understanding of the pigments G, but are actually aggregate that is close to a mass.

The pigments G, in a state of being dispersed in the ink Q (FIG. 1), are kept so as not to coagulate due to differences in ionization tendency. In other words, the pigments G are in a state of being coated with what is positively or negatively charged, and repulsive force acts on the pigments G. Here, when frozen, the coating of the pigments G is in a state of being removed, so it is assumed that the repulsive force is unlikely to act on the pigments G, and the pigments G coagulate.

In a state where the cooling by the cooling unit 82 is stopped, and the solid S is accommodated in the reservoir 72, the heating unit 86 is energized by the power source 52 to start heating of the solid S.

Figure 4:
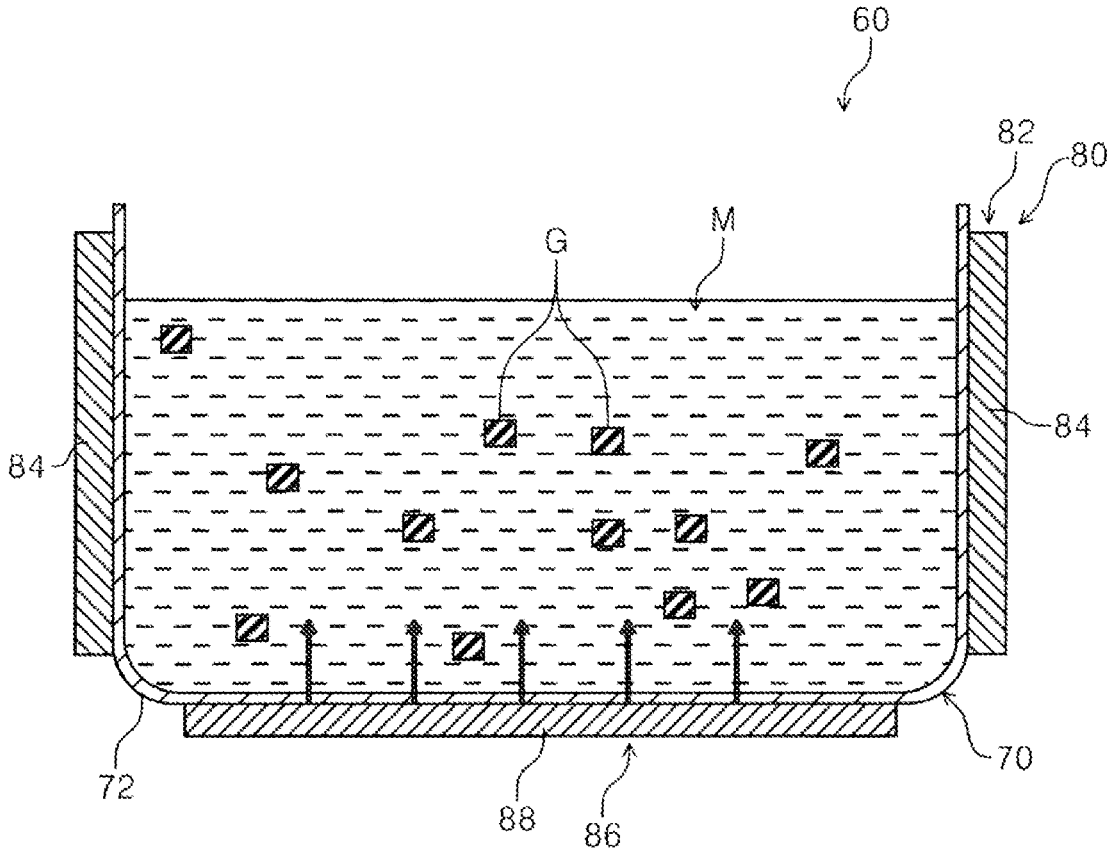
FIG. 4 is a schematic diagram illustrating a state in which the recovered liquid solidified in the coagulation unit of Exemplary Embodiment 1 melts and changes to a mixture.

As illustrated in FIG. 3 and FIG. 4, the solid S is melted by being heated by the heating unit 86 such that the solid S liquefies. This generates the mixture M. In accordance with the generation of the mixture M, the heating by the heating unit 86 is stopped.

Figure 5:
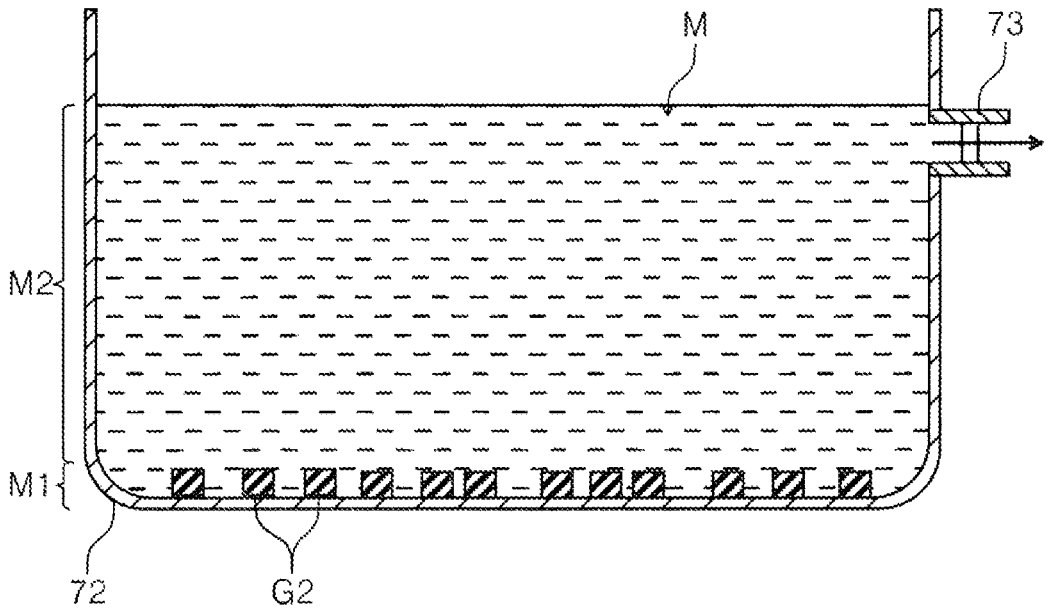
FIG. 5 is a schematic diagram illustrating a state in which a cleaning liquid is recovered from the mixture in the coagulation unit of Exemplary Embodiment 1.

FIG. 5 illustrates a state in which the temperature change unit 80 is removed from the reservoir 72. When the mixture M is left alone, the pigments G precipitate, thereby separating a lower layer M1 containing a large amount of the pigments G, and an upper layer M2 containing a large amount of the cleaning liquids C. Here, an outflow port 73 is provided in a part of the reservoir 72 to effuse the upper layer M2, which is a supernatant, and recover the upper layer M2 in a container (not illustrated). Most of the supernatant recovered in the container is composed of the cleaning liquid C.

Figure 6:
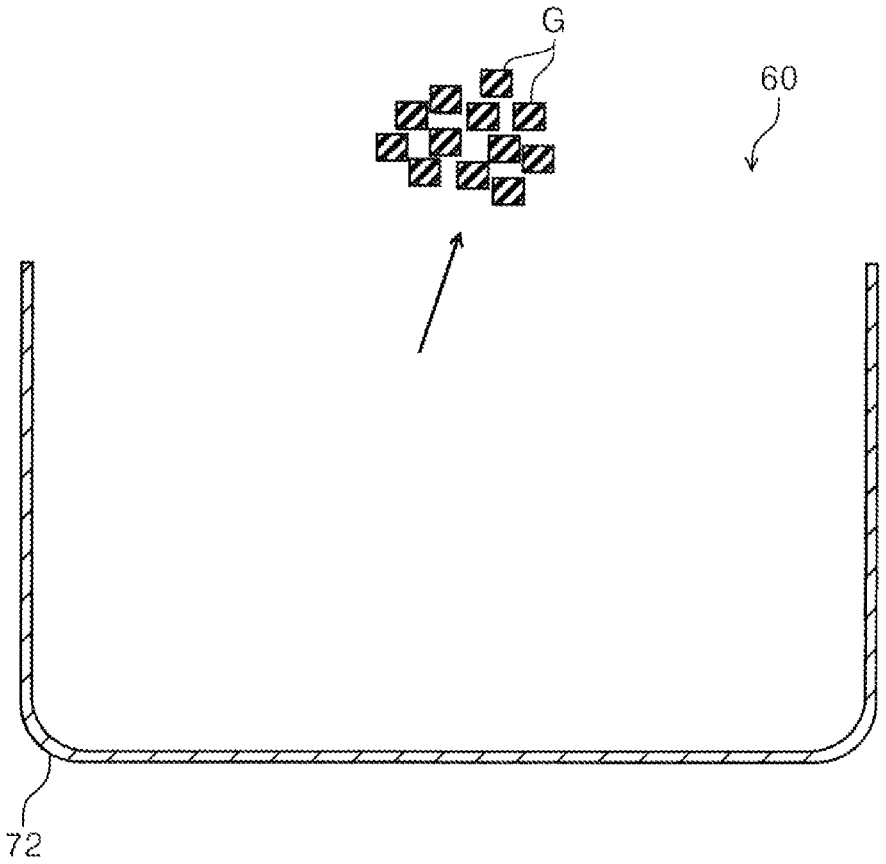
FIG. 6 is a schematic diagram illustrating a state in which pigment remaining in the coagulation unit of Exemplary Embodiment 1 is recovered.

As illustrated in FIG. 6, the pigments G are recovered from the reservoir 72 in which the pigments G precipitate. In this way, in the coagulation unit 60 of Exemplary Embodiment 1, each of the cleaning liquid C and the pigments G can be recovered by using a sedimentation method, as an example.

As described above, according to the coagulation method and the coagulation unit 60 of Exemplary Embodiment 1, the pigments G disperse in the recovered liquid K after being used in the cleaning of the glue belt 26 (FIG. 1). Furthermore, by coagulating the dispersed pigments G, the pigments G are easily recovered. This makes it easier to separate the cleaning liquid C component from the recovered liquid K, making it possible to facilitate the reuse of the cleaning liquid C for cleaning of the glue belt 26.

According to the printer 10, the pigments G are easily separated from the recovered liquid K, thus it is possible to suppress a reduction in cleaning performance of the glue belt 26, when the cleaning liquid C is reused.

Modified Example 1 of Exemplary Embodiment 1

Next, a coagulation method, the coagulation unit 60, and the printer 10 according to Modified Example 1 of Exemplary Embodiment 1 will be described in detail. Note that, parts common to those of the coagulation method, the coagulation unit 60, and the printer 10 according to Exemplary Embodiment 1 are denoted by the same reference signs, and descriptions thereof will be omitted.

The coagulation method, the coagulation unit 60, and the printer 10 of Modified Example 1 are substantially the same as those of Exemplary Embodiment 1, but a method of recovering the pigments G from the solid S is different from that of Exemplary Embodiment 1.

Figure 7:
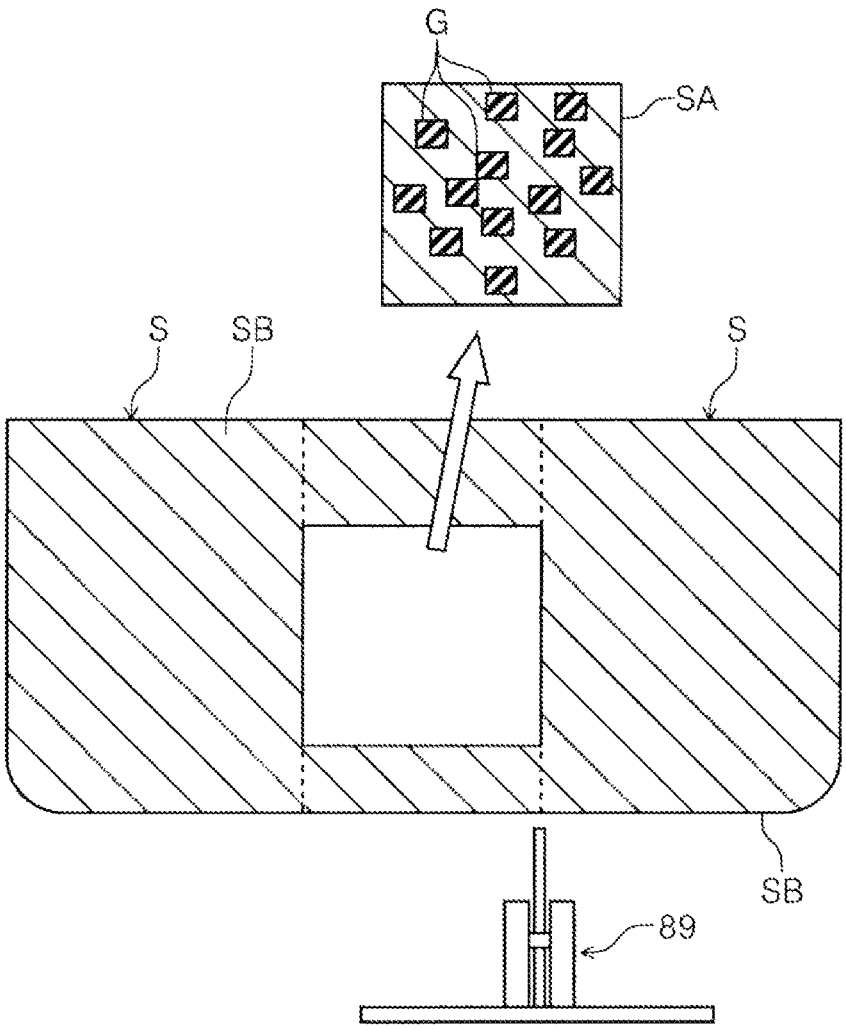
FIG. 7 is a schematic diagram illustrating a state in which a part containing pigment is cut out from a recovered liquid solidified in a coagulation unit of Modified Example 1 of Exemplary Embodiment 1.

FIG. 7 illustrates a state in which the solid S obtained by the coagulation method of Exemplary Embodiment 1 is cut by a cutting machine 89. When the solid S is generated by cooling the recovered liquid K, points of time at which a plurality of parts of the recovered liquid K solidify differ from each other, so concentration of the pigments G in each part is not even. Many of the pigments G collect, rather than in an outer edge of the solid S, in an inside where solidification occurs later. A central portion SA in which these pigments G collect is cut into a cuboid shape by the cutting machine 89, as an example. Note that, of the solid S, a remaining part except the central portion SA is referred to as a remaining portion SB.

In the central portion SA, a mixing ratio of the pigments G is greater compared to the remaining portion SB. Thus, the central portion SA as is can be discarded as the pigments G.

The remaining portion SB has a small amount of the pigments G. Thus, as an example, by melting and leaving alone the remaining portion SB to precipitate the remaining pigments G, it is possible to recover the cleaning liquid C becoming the supernatant.

There is such a method for recovering the pigments G by cutting the coagulated pigments G from the solid S.

Modified Example 2 of Exemplary Embodiment 1

Next, a coagulation method, the coagulation unit 60, and the printer 10 according to Modified Example 2 of Exemplary Embodiment 1 will be described in detail. Note that, parts common to those of the coagulation method, the coagulation unit 60, and the printer 10 according to Exemplary Embodiment 1 are denoted by the same reference signs, and descriptions thereof will be omitted.

The coagulation method, the coagulation unit 60, and the printer 10 of Modified Example 2 are substantially the same as those of Exemplary Embodiment 1, but a method of recovering the pigments G from the solid S is different from those of Exemplary Embodiment 1 and Modified Example 1.

Figure 8:
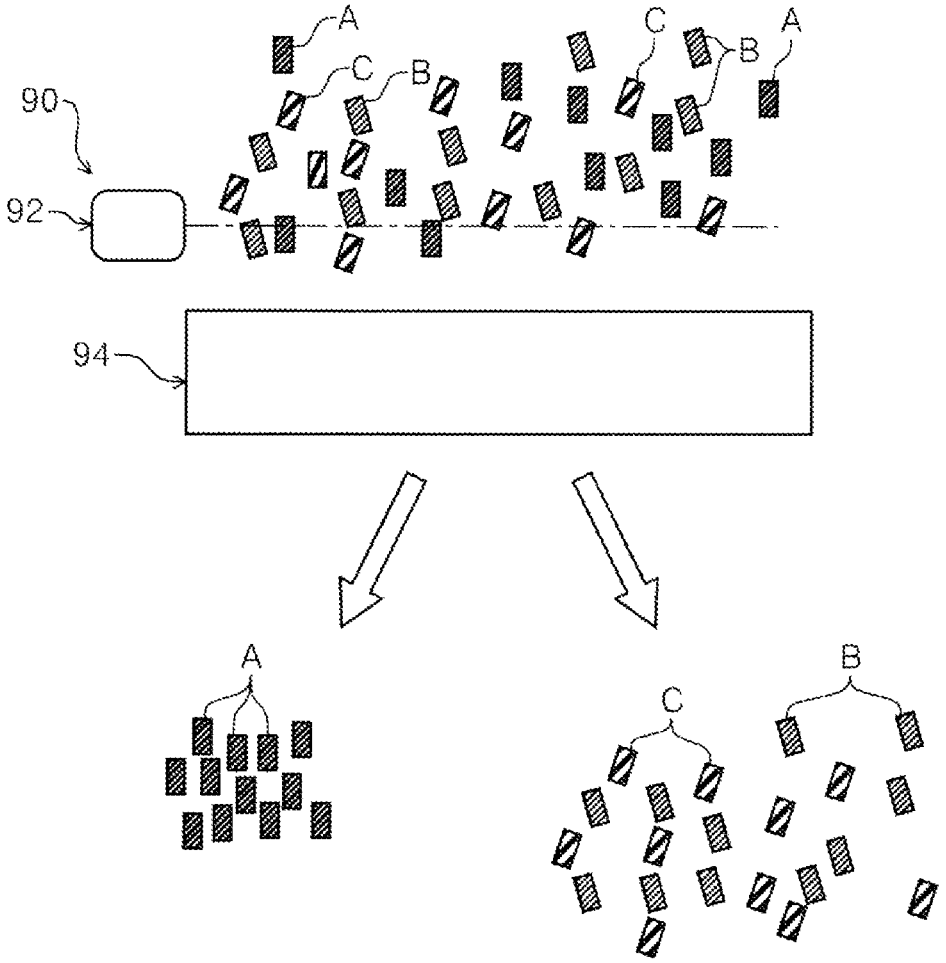
FIG. 8 is a schematic diagram illustrating a state in which a recovered liquid solidified in a coagulation unit of Modified Example 2 of Exemplary Embodiment 1 is pulverized and pigment is screened out.

FIG. 8 illustrates a state in which the solid S (FIG. 3) obtained by the coagulation method of Exemplary Embodiment 1 is pulverized by a pulverizer (not illustrated), and then screened out. Note that, the solid S is pulverized in advance into a plurality of chips each having a size that does not melt during the screening.

Here, a chip containing the pigments G the most is referred to as a chip A, a chip having a lower mixing ratio of the pigments G compared to the chip A is referred to a chip B, and a chip having a lower mixing ratio of the pigments G compared to the chip B is referred to as a chip C. Note that, the chip A, the chip B, and the chip C illustrated in FIG. 8 are partially extracted, and are illustrated with the mixing ratios different from actual mixing ratios. In addition, the mixing ratio is, for example, a ratio of volume of the pigments G contained in a single chip with respect to volume of the single chip.

The chip A, the chip B, and the chip C are screened out by a screening device 90, as an example.

The screening device 90 includes an identification unit 92 that is capable of identifying the chip A, the chip B, and the chip C, and a separation unit 94 that separates the chip A from the chip B and the chip C, among the chip A, the chip B, and the chip C identified in the identification unit 92.

The identification unit 92 is configured to include, for example, a camera that performs identification using near infrared rays.

The separation unit 94 is configured to include an air nozzle (not illustrated). In addition, the separation unit 94 blows off the chip B and the chip C detected by the identification unit 92 using air. On the other hand, the chip A falls due to its own weight. As a result, the chip A is separated. There is such a method for recovering a part containing a large amount of the pigments G by pulverizing and screening the solid S.

Exemplary Embodiment 2

Next, a coagulation method, a coagulation unit 100, and the printer 10 according to Exemplary Embodiment 2 will be specifically described. Note that, parts common to those of the coagulation method, the coagulation unit 60, and the printer 10 according to Exemplary Embodiment 1 are denoted by the same reference signs, and descriptions thereof will be omitted. Exemplary Embodiment 2 is different in that the coagulation unit 100 is used in the printer 10 instead of the coagulation unit 60.

Figure 9:
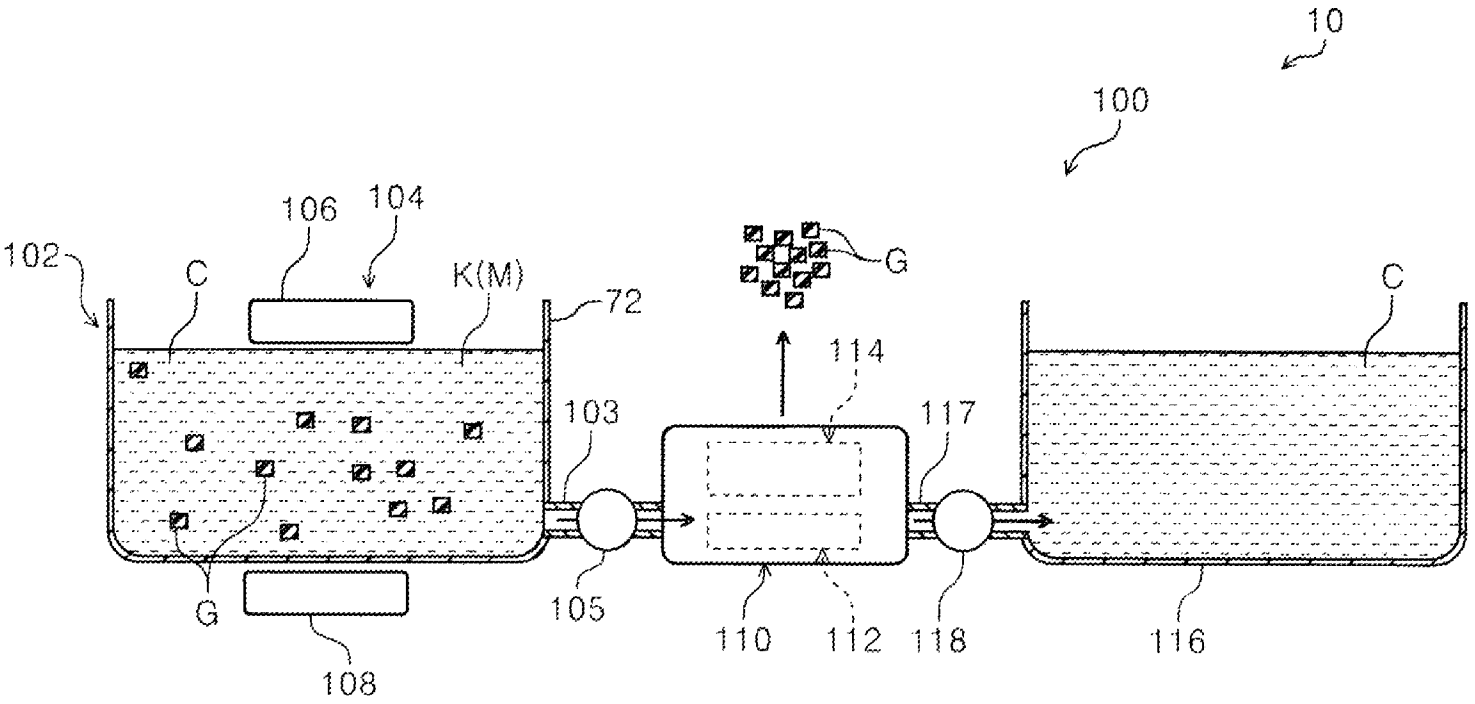
FIG. 9 is a schematic diagram illustrating a state in which a mixture is separated into pigment and a cleaning liquid by filtration and centrifugation in a coagulation unit of Exemplary Embodiment 2.

As illustrated in FIG. 9, the coagulation unit 100 includes a storage unit 102, a temperature change unit 104, a separation unit 110, and a recovery tank 116.

The storage unit 102 has the reservoir 72. A supply pipe 103 is coupled to a bottom of the reservoir 72.

The temperature change unit 104 includes a cooler unit 106 and a heater unit 108.

Since a Peltier effect is generated by energization by the power source 52 (FIG. 1), the cooler unit 106 cools the reservoir 72 and solidifies the recovered liquid K inside the reservoir 72.

The heater unit 108 is energized by the power source 52 and heats the reservoir 72 to melt or liquefy the solid S (FIG. 3) inside the reservoir 72.

The separation unit 110 is coupled to an inside of the reservoir 72 via the supply pipe 103. The supply pipe 103 is provided with a supply pump 105. Also, as an example, the separation unit 110 includes a filtration unit 112 and a centrifugation unit 114.

The filtration unit 112 is configured to include a filter (not illustrated). In addition, the filtration unit 112 filters the mixture M generated by the solid S generated in the storage unit 102 being heated by the temperature change unit 104.

The centrifugation unit 114 performs centrifugation to separate the pigments G from the mixture M.

Note that, in the separation unit 110, the centrifugation is performed by the centrifugation unit 114 for the mixture M after the filtration is performed in the filtration unit 112.

An inside of the recovery tank 116 is coupled to the separation unit 110 via a discharge pipe 117. The discharge pipe 117 is provided with a discharge pump 118. Liquid approximately close to the cleaning liquid C after the pigments G are separated in the separation unit 110 is stored inside the recovery tank 116.

Next, an action of the coagulation method, the coagulation unit 100, and the printer 10 of Exemplary Embodiment 2 will be described.

In the coagulation unit 100, the cooler unit 106 is energized by the power source 52 to solidify the recovered liquid K inside the reservoir 72. This causes the pigments G to coagulate in a central portion of the solid S (FIG. 3). Then, the energizing the cooler unit 106 is stopped.

Subsequently, the heater unit 108 heats the solid S by being energized by the power source 52. As a result, the mixture M is generated inside the reservoir 72. Then, the energizing the heater unit 108 is stopped.

The supply pump 105 is driven to supply the mixture M inside the reservoir 72 to the separation unit 110.

In the separation unit 110, the filtration unit 112 separates the pigments G by filtering the mixture M.

Subsequently, the centrifugation unit 114 further separates the pigments G by performing centrifugation for the mixture M containing a part of the remaining pigments G.

The discharge pump 118 is driven to discharge the cleaning liquid C separated from the pigments G in the separation unit 110 into the recovery tank 116.

As described above, according to the coagulation method, the coagulation unit 100, and the printer 10 of Exemplary Embodiment 2, a liquid after components of the pigments G are removed from the mixture M using the filtration unit 112 can be reused as the cleaning liquid C for cleaning the glue belt 26.

In addition, by efficiently removing the pigments G from the mixture M using the centrifugation unit 114, a liquid after component of the pigments G are removed from the mixture M can be reused as the cleaning liquid C for cleaning the glue belt 26. In addition, compared to a sedimentation method, a time for removing the components of the pigments G from the mixture M can be shortened.

Exemplary Embodiment 3

Next, a coagulation method, a coagulation unit 120, and the printer 10 according to Exemplary Embodiment 3 will be specifically described. Note that, parts common to those of the coagulation method, the coagulation unit 60, and the printer 10 according to Exemplary Embodiment 1 are denoted by the same reference signs, and descriptions thereof will be omitted.

Exemplary Embodiment 3 is different in that the coagulation unit 120 is used in the printer 10 instead of the coagulation unit 60.

Figure 10:
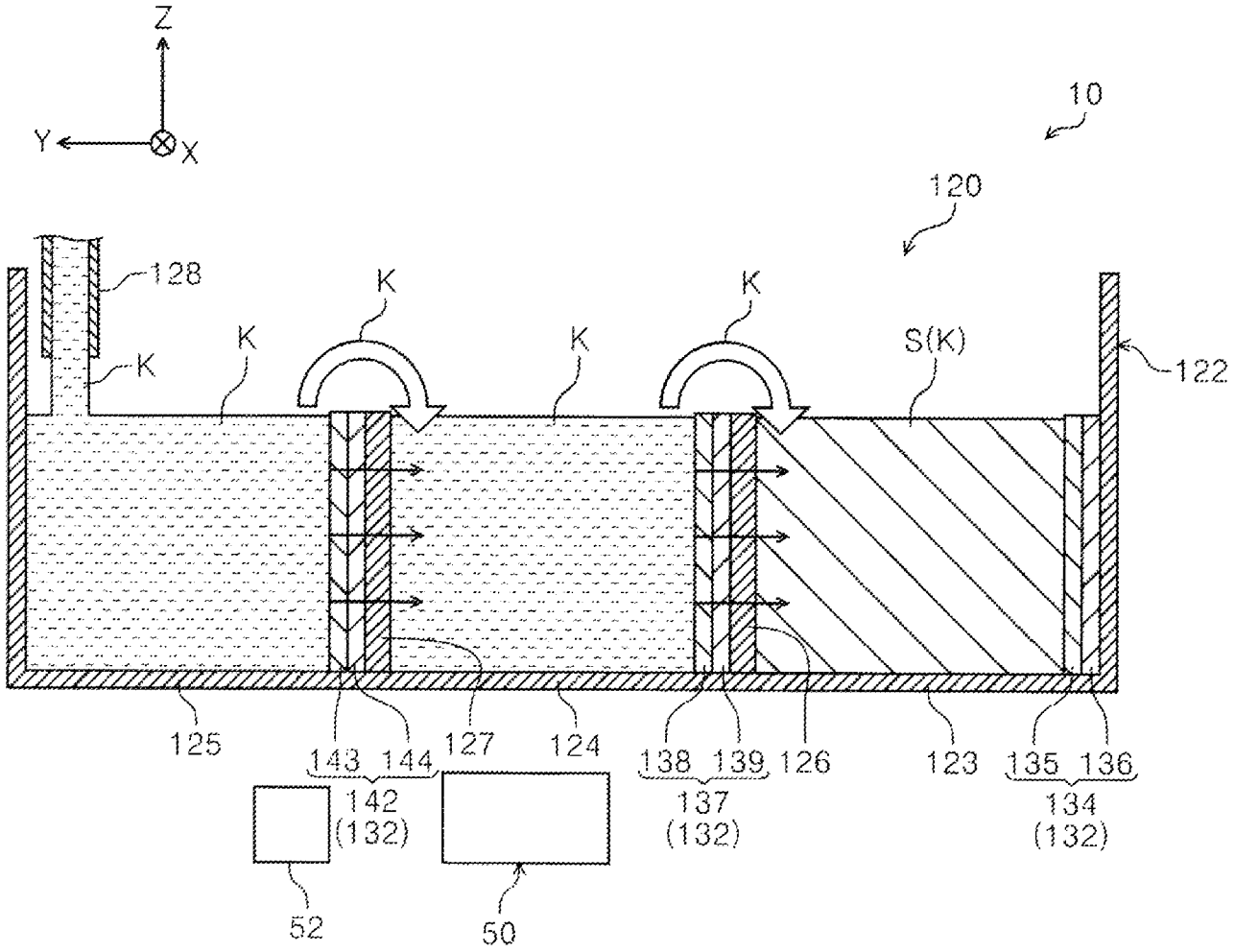
FIG. 10 is a schematic diagram illustrating a state in which a recovered liquid solidifies or melts by performing heat transfer among a plurality of adjacent reservoirs in a coagulation unit of Exemplary Embodiment 3.

As illustrated in FIG. 10, the coagulation unit 120 includes a storage unit 122, a temperature change unit 132, the controlling unit 50, and the power source 52. The controlling unit 50 in Exemplary Embodiment 3 is an example of a control unit.

The storage unit 122 includes, as an example, a reservoir 123, a reservoir 124, and a reservoir 125. The reservoir 123 is an example of a first storage unit. The reservoir 124 is an example of a second storage unit with respect to the reservoir 123. In addition, the reservoir 124 is also an example of the first storage unit with respect to the reservoir 125. The reservoir 125 is an example of a third storage unit. In addition, when the reservoir 124 is regarded as the first storage unit with respect to the reservoir 125, the reservoir 125 is also an example of the second storage unit.

The reservoir 124 is located downstream the reservoir 123 in the +Y direction. The reservoir 125 is located downstream the reservoir 124 in the +Y direction. The reservoirs 123, 124, and 125 are each capable of storing the recovered liquid K.

The reservoir 123 and the reservoir 124 are partitioned by a partition wall 126 that stands upright in the +Z direction. The reservoir 124 and the reservoir 125 are partitioned by a partition wall 127 that stands upright in the +Z direction. A height of the partition wall 126 in the +Z direction and a height of the partition wall 127 in the +Z direction are approximately the same height, as an example. The partition wall 126 and the partition wall 127 also include, as an example, components of aluminum.

A drain pipe 128 is provided at a predetermined location in the +Z direction with respect to the reservoir 125. The recovered liquid K recovered after cleaning the glue belt 26 (FIG. 1) flows from the drain pipe 128 to the reservoir 125 only. The recovered liquid K contains the pigments G (FIG. 3).

When the reservoir 125 is full, the recovered liquid K overflowing from the reservoir 125 flows into the reservoir 124. When the reservoir 124 is full, the recovered liquid K overflowing from the reservoir 124 flows into the reservoir 123. In this manner, the recovered liquid K is stored in an order of the reservoir 125, the reservoir 124, and the reservoir 123.

The temperature change unit 132 includes a temperature changing unit 134 for changing a temperature of the recovered liquid K stored in the reservoir 123, a temperature changing unit 137 for changing a temperature of the recovered liquid K stored in the reservoir 124, and a temperature changing unit 142 for changing a temperature of the recovered liquid K stored in the reservoir 125.

The temperature changing unit 134 is an example of a first temperature change unit. Specifically, the temperature changing unit 134 is constituted by an endothermic plate 135, a heat dissipating plate 136, and a Peltier element (not illustrated). The Peltier element is sandwiched between the endothermic plate 135 and the heat dissipating plate 136, and is energized by the power source 52 to generate a Peltier effect. The heat dissipating plate 136 is attached to a side wall in the −Y direction of the reservoir 123. The endothermic plate 135 is exposed to an inside of the reservoir 123.

The temperature changing unit 137 is an example of a second temperature change unit. Note that, the temperature changing unit 137 is also an example of the first temperature change unit. The temperature changing unit 137 is capable of discharging heat to the reservoir 123, when cooling the recovered liquid K in the reservoir 124. Specifically, the temperature changing unit 137 is constituted by an endothermic plate 138, a heat dissipating plate 139, and a Peltier element (not illustrated). The Peltier element is sandwiched between the endothermic plate 138 and the heat dissipating plate 139, and is energized by the power source 52 to generate a Peltier effect. The heat dissipating plate 139 is attached to a surface in the +Y direction of the partition wall 126. The endothermic plate 138 is exposed to an inside of the reservoir 124.

The temperature changing unit 142 is an example of a third temperature change unit. Note that, when the temperature changing unit 137 is regarded as the first temperature change unit, the temperature changing unit 142 is also an example of the second temperature change unit. The temperature changing unit 142 is capable of discharging heat to the reservoir 124, when the recovered liquid K is cooled in the reservoir 125. Specifically, the temperature changing unit 142 is constituted by an endothermic plate 143, a heat dissipating plate 144, and a Peltier element (not illustrated). The Peltier element is sandwiched between the endothermic plate 143 and the heat dissipating plate 144, and is energized by the power source 52 to generate a Peltier effect. The heat dissipating plate 144 is attached to a surface in the +Y direction of the partition wall 127. The endothermic plate 143 is exposed to an inside of the reservoir 125.

Note that, the endothermic plates 135, 138, and 143, and the heat dissipating plates 136, 139, and 144 may be made of metal, a thermally conductive ceramic, or the like.

Additionally, the endothermic plate 138, the heat dissipating plate 139, and the partition wall 126 are an example of members constituting a heat transfer path between the reservoir 123 and the reservoir 124. The endothermic plate 143, the heat dissipating plate 144, and the partition wall 127 are an example of members constituting a heat transfer path between the reservoir 124 and the reservoir 125. In other words, the coagulation unit 120 and the printer 10 have a heat transfer unit that transfers heat discharged from the second temperature change unit to the first storage unit. Here, for the heat transfer unit, a thermal conduction method need not be adopted in which a plurality of members are combined as in the present exemplary embodiment. For example, a thermal conduction method with a single member may be used. Further, the heat discharged from the second temperature change unit may be transferred to the first storage unit by radiation, convection generated by flowing air, or the like.

The controlling unit 50 controls operation of the temperature changing units 134, 137, and 142. In addition, the controlling unit 50 causes the temperature changing unit 134 to stop the operation, after causing the temperature changing unit 134 to solidify the recovered liquid K stored in the reservoir 123. Furthermore, after the operation of the temperature changing unit 134 is stopped, the controlling unit 50 performs control to cause the reservoir 123 to be heated by heat discharged from the temperature changing unit 137.

The controlling unit 50 causes the temperature changing unit 137 to stop the operation, after causing the temperature changing unit 137 to solidify the recovered liquid K stored in the reservoir 124. Furthermore, after the operation of the temperature changing unit 137 is stopped, the controlling unit 50 performs control to cause the reservoir 124 to be heated by heat discharged from the temperature changing unit 142.

In other words, the controlling unit 50 causes the temperature changing unit 134 to stop the operation for cooling the recovered liquid K stored in the reservoir 123, after causing the temperature changing unit 134 to solidify the recovered liquid K stored in the reservoir 123, and after the operation of the temperature changing unit 134 for cooling the recovered liquid K stored in the reservoir 123 is stopped, performs control such that the temperature changing unit 137 cools the recovered liquid K stored in the reservoir 124 while discharging heat to the reservoir 123. Note that, the controlling unit 50 may perform control such that the temperature changing unit 134 heats the solid S in the reservoir 123, when the temperature changing unit 137 cools the recovered liquid K stored in the reservoir 124 while discharging heat to the reservoir 123. In addition, the controlling unit 50 may perform control to cause the temperature changing unit 134 to completely stop the operation, when the temperature changing unit 137 cools the recovered liquid K stored in the reservoir 124 while discharging heat to the reservoir 123.

The controlling unit 50 causes the temperature changing unit 137 to stop the operation for cooling the recovered liquid K stored in the reservoir 124, after causing the temperature changing unit 137 to solidify the recovered liquid K stored in the reservoir 124, and after the operation of the temperature changing unit 137 for cooling the recovered liquid K stored in the reservoir 124 is stopped, performs control such that the temperature changing unit 142 cools the recovered liquid K stored in the reservoir 125 while discharging heat to the reservoir 124. Note that, the controlling unit 50 may perform control such that the temperature changing unit 137 heats the solid S in the reservoir 124, when the temperature changing unit 142 cools the recovered liquid K stored in the reservoir 125 while discharging heat to the reservoir 124. In addition, the controlling unit 50 may perform control to cause the temperature changing unit 137 to completely stop the operation, when the temperature changing unit 142 cools the recovered liquid K stored in the reservoir 125 while discharging heat to the reservoir 124.

Furthermore, a detector may be provided that detects a degree of solidification of the recovered liquid K stored in each of the reservoirs 123, 124, and 125. For example, as the detector, a temperature sensor may be used. In this case, based on a detection result of the temperature sensor, the controlling unit 50 can determine whether the recovered liquid K stored in each of the reservoirs 123, 124, and 125 is solidified or not. Note that, a sensor unit may be used as the detector that includes a vibration piece immersed in the recovered liquid K, and an actuator that vibrates the vibration piece. In this case, when a part of the recovered liquid K that comes into contact with the vibrating piece solidifies, the vibration piece is less likely to vibrate, and a current is changed that is to be supplied to the actuator in order to cause the vibration piece to vibrate with a predetermined amplitude. Based on the change in the current supplied to the actuator, the controlling unit 50 can determine whether the recovered liquid K stored in each of the reservoirs 123, 124, and 125 is solidified or not.

Next, an action of the coagulation method, the coagulation unit 120, and the printer 10 of Exemplary Embodiment 3 will be described.

A predetermined amount of the recovered liquid K is stored in each of the reservoir 125, the reservoir 124, and the reservoir 123. Here, when the reservoir 123 is substantially full, the power source 52 energizes the temperature changing unit 134. By this energization, a Peltier element (not illustrated) is operated, and thus heat is absorbed in the endothermic plate 135 and is dissipated in the heat dissipating plate 136. As a result, a temperature of the recovered liquid K in the reservoir 123 is reduced, and the recovered liquid K becomes the solid S. Then, the energizing the temperature changing unit 134 is stopped.

Subsequently, the temperature changing unit 137 is energized by the power source 52. By this energization, heat is absorbed in the endothermic plate 138, and is dissipated in the heat dissipating plate 139. As a result, a temperature of the recovered liquid K in the reservoir 124 is reduced, and the recovered liquid K becomes the solid S. At this time, the heat dissipated from the heat dissipating plate 139 moves to the solid S in the reservoir 123 via the partition wall 126. This restores the solid S in the reservoir 123 to the mixture M (FIG. 4). Then, the energizing the temperature changing unit 137 is stopped.

Subsequently, the temperature changing unit 142 is energized by the power source 52. By this energization, heat is absorbed in the endothermic plate 143, and is dissipated in the heat dissipating plate 144. As a result, a temperature of the recovered liquid K in the reservoir 125 is reduced, and the recovered liquid K becomes the solid S. At this time, the heat dissipated from the heat dissipating plate 144 moves to the solid S in the reservoir 124 via the partition wall 127. This restores the solid S in the reservoir 124 to the mixture M. Then, the energizing the temperature changing unit 142 is stopped.

As described above, according to the coagulation method, the coagulation unit 120, and the printer 10 of Exemplary Embodiment 3, even when heating is not performed using the temperature changing units 134 and 137, the solidified solid S in the reservoir 123 and 124 can be restored to the mixture M, which is liquid, again, by using the heat discharged from the temperature changing units 137 and 142. This allows energy consumed by the coagulation unit 120 and the printer 10 to be reduced.

The coagulation method, the coagulation units 60, 100, 120, and the printer 10 according to the exemplary embodiments of the present disclosure are based on the configuration described above. However, as a matter of course, modifications, omission, and the like may be made to a partial configuration without departing from the gist of the disclosure of the present application.

In the coagulation unit 60, when an atmospheric temperature is sufficiently low, the recovered liquid K may be solidified by leaving alone the reservoir 72 in which the recovered liquid K is stored, in the atmosphere. In this case, power required for solidification and the like are unnecessary, and thus energy for solidifying the recovered liquid K can be reduced. In addition, when the atmospheric temperature fluctuates greatly during one day, leaving the recovered liquid K alone allows thawing after solidification.

In the coagulation unit 60, when concentration of the pigments G in the recovered liquid K is high, the pigments G do not coagulate very much when the recovered liquid K is frozen in some cases. In this case, after the recovered liquid K is diluted using water or the cleaning liquid C, by solidifying the recovered liquid K, more of the pigments G can be coagulated.

When cooling by the cooling unit 82 is performed in the coagulation unit 60, the present disclosure is not limited to a method for uniformly cooling the entire reservoir 72, and the reservoir 72 may be partially cooled by setting a time difference.

The cooling unit 82 and the heating unit 86 may be provided at a position opposite to the reservoir 72. In Modified Example 2, the pulverized chips A, B, and C may be separated not by free-fall, but while being transported using a belt conveyor.

In the coagulation unit 100, the separation unit 110 may be constituted of only the filtration unit 112 or only the centrifugation unit 114. Furthermore, after the centrifugation unit 114 is used in advance, the filtration unit 112 may be used.

In the coagulation unit 120, the reservoir 125 and the temperature changing unit 142 need not be present. Furthermore, the number of each of the reservoirs and the temperature changing units may be four or more.

In the temperature change unit, cooling and heating may be performed by different members, respectively, or one member may have both cooling and heating functions. Furthermore, as an example of the temperature change unit, not only a temperature change unit having a cooling unit using a Peltier element, but also a temperature change unit having a heat pump may be used.

The recovered liquid K is not limited to a recovered liquid recovered from the glue belt 26, and may be, for example, a recovered liquid recovered by cleaning a member different from the glue belt 26, such as the recording head 32.

In the cooling, both of a state in which a part of the recovered liquid K is solidified, and a state in which all of the recovered liquid K is solidified, are allowed.

What is claimed is:

1. A coagulation method for a liquid containing pigment and a cleaning liquid recovered from a liquid ejecting device, the method comprising:

storing the liquid;

cooling the liquid such that at least a part of the liquid solidifies; and heating a solid generated by solidifying at least a part of the liquid in order to liquefy the solid.

2. A coagulation device for performing coagulation treatment for a liquid containing pigment and a cleaning liquid recovered from a liquid ejecting device, the coagulation device comprising:

a storage unit configured to store a liquid containing the pigment and the cleaning liquid; and a temperature change unit configured to change a temperature of the liquid stored in the storage unit, wherein the temperature change unit is configured to cool the liquid such that at least a part of the liquid solidifies, and heat a solid generated by solidifying at least a part of the liquid in order to liquefy the solid.

3. The coagulation device according to claim 2, comprising:

a filtration unit configured to filter a mixture generated by heating the solid.

4. The coagulation device according to claim 2, comprising:

a centrifugation unit configured to perform centrifugation to separate the pigment from a mixture generated by heating the solid.

5. The coagulation device according to claim 2, comprising:

a second storage unit configured to store the liquid, when the storage unit is a first storage unit;

a second temperature change unit configured to change a temperature of the liquid stored in the second storage unit, when the temperature change unit that changes a temperature of the liquid stored in the first storage unit is a first temperature change unit; and a control unit configured to control operation of the first temperature change unit and operation of the second temperature change unit, wherein the second temperature change unit is configured to discharge heat to the first storage unit when the liquid is cooled, the control unit, after causing the first temperature change unit to solidify the liquid stored in the first storage unit, causes the first temperature change unit to stop operation of cooling the liquid stored in the first storage unit, and after the operation of cooling the liquid stored in the first storage unit by the first temperature change unit is stopped, performs control such that the second temperature change unit cools the liquid stored in the second storage unit while discharging heat to the first storage unit.

6. An ejecting device, comprising:

a transport unit configured to transport a medium;

an ejecting unit configured to eject a composition containing pigment onto the medium;

a cleaner unit configured to clean, with a cleaning liquid, the transport unit to which the composition adheres;

a storage unit configured to store a liquid containing the pigment and the cleaning liquid; and a temperature change unit configured to change a temperature of the liquid stored in the storage unit, wherein the temperature change unit is configured to cool the liquid such that the liquid solidifies, and heat a solid generated by solidifying the liquid in order to liquefy the solid.

* * * * *